United States Patent [19]

Lovrich et al.

[11] Patent Number: 4,580,621

[45] Date of Patent: Apr. 8, 1986

[54] HEAT EXCHANGER FOR RECOVERY OF WASTE HEAT FROM FLUE GASES

[76] Inventors: John Lovrich, Nanuet, N.Y.; Merrial E. Lovrich, administratrix, 307 S. Middletown Rd., Nanuet, N.Y. 10954

[21] Appl. No.: 594,032

[22] Filed: Mar. 27, 1984

[51] Int. Cl.[4] ..... F28D 15/00; F24B 7/00

[52] U.S. Cl. ..... 165/47; 165/104.19; 165/901; 237/55

[58] Field of Search ..... 165/104.21, 104.19, 165/DIG. 2, 47, DIG. 12; 237/55; 126/117; 122/20 B

[56] References Cited

U.S. PATENT DOCUMENTS

| | | | |
|---|---|---|---|
| 1,725,906 | 8/1929 | Gay | 126/117 |
| 2,206,858 | 7/1940 | McKee | 165/909 |
| 2,291,985 | 8/1942 | Powers | 165/DIG. 2 |
| 3,913,663 | 10/1975 | Gates | 165/154 |
| 4,044,820 | 8/1977 | Nobles | 165/104.14 |
| 4,050,628 | 9/1977 | Konnerth, III | 237/55 |
| 4,078,602 | 3/1978 | Richer | 165/DIG. 2 |
| 4,241,874 | 12/1980 | Schossow | 165/104.19 |
| 4,369,918 | 1/1983 | David et al. | 237/55 |

FOREIGN PATENT DOCUMENTS

| | | | |
|---|---|---|---|
| 537696 | 4/1955 | Belgium | 165/47 |
| 531458 | 1/1922 | France | 165/122 |
| 956654 | 2/1950 | France | 165/104.19 |
| 1026983 | 5/1953 | France | 165/104.21 |
| 815308 | 6/1959 | United Kingdom | 237/55 |
| 1495696 | 12/1977 | United Kingdom | 237/55 |

*Primary Examiner*—William R. Cline
*Assistant Examiner*—John K. Ford

[57] ABSTRACT

A heat exchanger for extracting and recovering waste heat from the flue of a heater, such as a furnace. The present heat exchanger includes a housing having a plurality of sealed, oil filled, parallel metallic finned tubes arranged around the periphery of the heat extractor chamber of the heat exchanger. Hot flue gases from the furnace travel between the inner housing and the outer housing. Thus, the hot flue gases pass through and around the finned tubes thereby heating the oil inside, so that a very large proportion of the heat of the flue gases is extracted by the finned tubes. The plurality of finned tubes are all connected together as one unit exposed to hot flue gases, thus once oil is heated in the tubes, the unit retains the heat even when furnace is not operating. The tubes are made of copper and act as an oil reservoir and heat sink for the heat absorbing fins. A blower exhausts clean heated air out of the rear duct for useful heating.

6 Claims, 3 Drawing Figures

HEAT EXCHANGER FOR RECOVERY OF WASTE HEAT FROM FLUE GASES

The present invention relates to oil filled, finned, heat exchanger tubes and more particularly, to the use heat of the heat from waste flue gases normally passing out of a chimney into the atmosphere.

Typical of the prior art devices for extracting heat from hot exhaust gases flowing through the flue of a furnace or boiler are U.S. Pat. Nos. 4,078,602; 4,050,628; 3,913,663 and French Pat. Nos. 531,458.

U.S. Pat. No. 4,078,602 discloses a heat box consisting of a plurality of tubes which contain air heated by flue gases passing over them. Due to the tube construction employed, the device employs an air to air heat extraction system and does not extract heat efficiently from the flue gas.

U.S. Pat. No. 4,050,628 discloses a heat reclaimer which employs an air to air heat extraction system and requires the use of relatively complicated motor operated dampers to operate properly and uses air ducts or conduits to extract the heat.

U.S. Pat. No. 3,913,663 also employs an air to air heat extractor.

French Pat. No. 531,458 employs a series of finned tubes in what appears to be an air to air heat extraction system in a damper regulated heat exchanger but fails to disclose the novel concepts of the present invention.

SUMMARY OF THE INVENTION

Accordingly, an object of the present invention is to provide an improved, oil filled, finned tube heat exchanger that recovers a substantial part of the waste heat that would otherwise pass with the flue gas into the atmosphere.

Another object of the invention is to provide an improved, oil filled finned tube heat exchanger that has an extremely high extraction efficiency.

A further object of the invention is to provide an improved, oil filled, finned tube heat exchanger that can be kept clean and free of soot by providing ready access on two sides of the cabinet and to internal parts therein.

Still another object of the invention is to provide an improved, oil filled, finned tube heat exchanger that can be adapted for a variety of heating systems, such as oil, coal gas or wood burning furnaces.

Yet another object of the invention is to provide an improved, oil filled, finned tube heat exchanger that is simple, practical, durable and economical in construction and is reliable and efficient in operation.

Other and further objects will be obvious upon examination of the illstrative embodiment hereafter described, and from a reading of the specification and the appended claims.

DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

Figure 2:
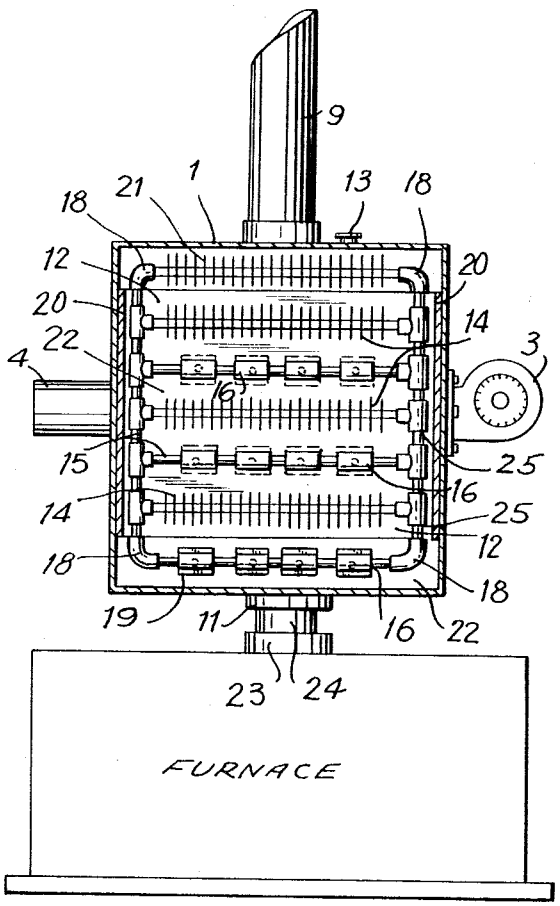
FIG. 2 is another perspective side view of the oil containing heat exchanger taken along line 2—2 of FIG. 3; showing the oil filled, finned tubes.
Figure 1:
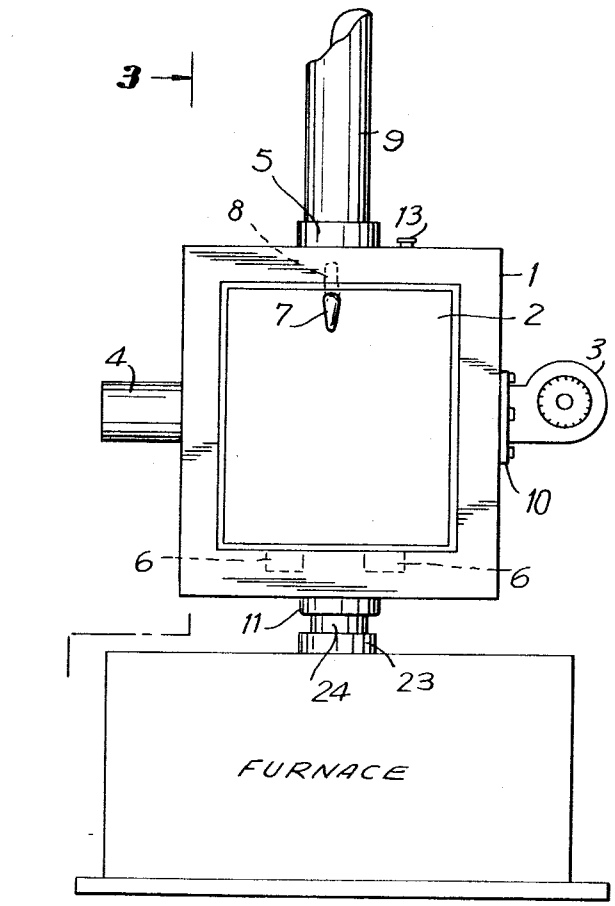
FIG. 1 is a perspective side view of a coil containing heat exchanger in accordance with the present invention.
Figure 3:
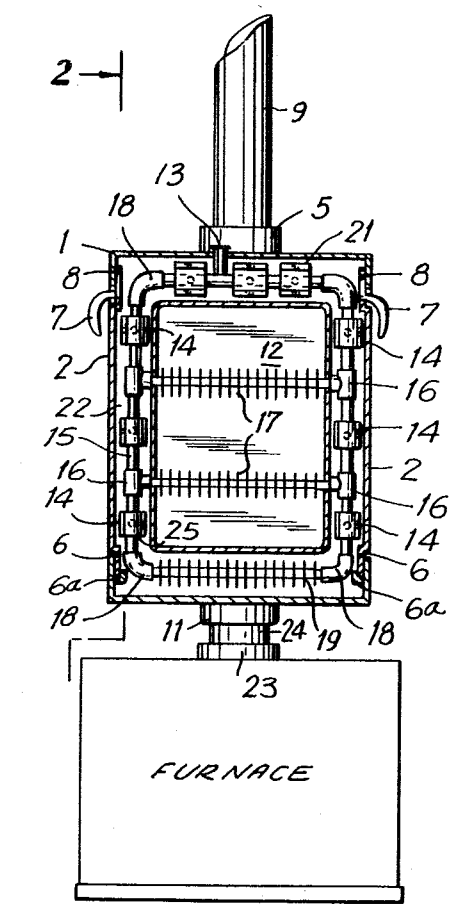
FIG. 3 is a front cross sectional view of the oil containing heat exchanger FIG. 2 taken along line 3—3 of FIG. 1; showing the oil filled, finned, heat exchanger tubes and the finned tube unit connections.

Referring now to the drawings in detail, a heat exchanger is shown that may be installed between the furnace and the smoke stack. The heat exchanger as shown in FIGS. 1, 2 and 3 includes an outer housing 1 having a blower 3 mounted on a side wall of said outer housing 1 by blower flange 10, a rear exhaust duct 4 located opposite said blower 3, a pair of access doors 2, each having a pair of mounting tabs 6 fastened to the lower end thereof and adapted to fit into brackets (not shown) fastened to the inside of said outer housing and a latch handle 7 operably connected to tongue latch 8 and, a flue pipe 9. Heat extractor outer housing 1 comprises a collar 11 connected to the furnace flue by furnace flue nipple 24 and furnace flue collar 23, a filler cap 13 for adding oil to the oil filled, finned, heat exchanger tubes 14, pipe nipples 15, pipe tubing tee 16, lower oil filled, finned, heat exchanger tubes 19, upper oil filled, finned, heat exchanger tubes 21, an inner housing 12, mountings 20 adapted to support said inner housing 12 within outer housing 1, oil filled, finned, heat exchanger tubes 17 in spaced, parallel relationship inside inner housing 12, pipe tube elbows 18, said outer housing 1 being spaced by space 22 from said inner housing 12 for passage of the flue gases. Pipe connections within the heat exchanger are shown typically at 25 and are preferably brazed.

From the foregoing description, it will be seen that by use of the oil filled, finned, heat exchanger tubes of this invention, the flow of flue gas across the finned tubes positioned in space 22 across the bottom of inner housing 12 and between the side walls of outer housing 1 and inner housing 12 and across the top of inner housing 12 optimized heat extraction from the flue gas.

In operation, hot flue gases leaving the furnace flow upward through flue nipple 24 into space 22 between heat exchanger outer housing 1 and inner housing 12 and across and around oil filled, finned, heat exchanger tubes 19 located across the lower end of said outer housing and then through space 22 between the vertical walls of said outer housing 1 and heat exchanger inner housing 12. In passing through space 22, said flue gases contact oil filled, finned, heat exchanger tubes 14 located in space 22 and then pass across oil filled, finned, heat exchanger tubes 21 in the upper portion of said heat exchanger before passing out through flue stack 9. The oil filled, finned, heat exchanger tubes 14, 19 and 21 absorb heat from the hot waste flue gases. The heated oil in said heat exchanger tubes circulates by convection through inner housing finned, heat exchanger tubes 17, although if desired, the oil can be circulated by pump means. Ambient air is moved by blower 3 across oil filled, finned, heat exchanger tubes 17 to extract heat therefrom. The heated air passes out of inner housing 12 through duct means 4 and may then be directed as required by duct means 4 for general heating purposes. It is intended that blower 3 be electrically connected to a conventional heating system so that it is energized whenever the circulator pump or main blower is energized.

As various changes may be made in the form, construction and arrangement of the parts herein, without departing from the spirit and scope of the invention and without sacrificing any of its advantages, it is to be understood that all matters are to be interpreted as illustrative and not in any sense limiting.

What is claimed is:

1. A heat exchanger for recovering waste heat from flue gas which comprises an outer housing, an inner housing within said outer housing and spaced therefrom, said outer housing having upper and lower flue connection means and four side walls, said inner housing having located therein spaced, parallel inner oil filled, finned, heat exchanger tubes and means for moving heated air from within said inner housing to the exterior of said outer housing, said space between said inner housing and said outer housing having located therein a series of outer oil filled, finned, heat exchanger tubes operably connected to said tubes in said inner housing.

2. The heat exchanger of claim 1 wherein said means for moving heated air from said inner housing comprises blower means and duct means passing from said inner housing through the exterior wall of said outer housing.

3. The heat exchanger of claim 1 wherein said outer housing has access means to said inner housing provided in two opposite side walls.

4. The heat exchanger of claim 3 wherein said access means comprises a pair of oppositely spaced, removable doors.

5. The heat exchanger of claim 1 wherein said inner and outer oil filled, finned heat exchanger tubes are provided with oil filler means.

6. The heat exchanger of claim 1, wherein said inner and outer oiled filled, finned heat exchanger tubes are operably connected to pump means.

* * * * *